US009782661B2

(12) United States Patent
Griffin et al.

(10) Patent No.: US 9,782,661 B2
(45) Date of Patent: Oct. 10, 2017

(54) ATHLETIC TIMING DEVICE

(71) Applicant: DAEDALUS DESIGN, LLC, Ann Arbor, MI (US)

(72) Inventors: Brent Griffin, Ann Arbor, MI (US); Maxim Markov, Boston, MA (US); Samuel Dion, Caledonia, MI (US)

(73) Assignee: Daedalus Design, LLC, Dexter, MI (US)

( * ) Notice: Subject to any disclaimer, the term of this patent is extended or adjusted under 35 U.S.C. 154(b) by 0 days.

(21) Appl. No.: 14/995,296

(22) Filed: Jan. 14, 2016

(65) Prior Publication Data

US 2016/0243426 A1 Aug. 25, 2016

Related U.S. Application Data

(60) Provisional application No. 62/104,903, filed on Jan. 19, 2015.

(51) Int. Cl.

| | |
|---|---|
| ***A63B 71/06*** | (2006.01) |
| ***G04G 21/08*** | (2010.01) |
| ***G04F 13/00*** | (2006.01) |
| ***G04F 13/02*** | (2006.01) |
| ***G04G 17/08*** | (2006.01) |
| ***G04G 21/02*** | (2010.01) |
| *A63B 69/00* | (2006.01) |

(52) U.S. Cl.

CPC ..... *A63B 71/0686* (2013.01); *G04F 13/00* (2013.01); *G04F 13/02* (2013.01); *G04G 17/08* (2013.01); *G04G 21/025* (2013.01); *A63B 69/00* (2013.01); *G04G 21/08* (2013.01)

(58) Field of Classification Search

CPC ..... A63B 2071/0688; A63B 71/0686; G04B 45/00; G04B 45/0069; G04F 13/00; G04F 13/02; G04G 17/08; G04G 21/025

See application file for complete search history.

(56) References Cited

U.S. PATENT DOCUMENTS 4,418,910 A * 12/1983 Stenerud ..... A63B 69/0075 473/420
4,775,151 A * 10/1988 Berry ..... A63B 71/06 473/420

(Continued)

OTHER PUBLICATIONS

"An Electronic Football Tee: Mississippi Blitz", orginally published Jan. 12, 2015, Beyond Design, full document, retrieved on Jan. 3 from <http://www.beyonddesignchicago.com/project/mississippi-blitz/>.*

*Primary Examiner* — Amy Cohen Johnson
*Assistant Examiner* — Daniel Wicklund

(57) ABSTRACT

An athletic timing device includes a housing carrying a touch-less sensor. The device is self-contained and can be easily placed at generally any point on a surface used for athletic activities, e.g., a football field, basketball court, or a track. The collective design of the sensor and the housing facilitates activation of the sensor without interfering with normal athletic activities, i.e., activities can be performed and timed under normal conditions without physical contact between the timing device and objects involved in the athletic activity. Example activities that can activate the sensor include snapping a football, kicking a soccer ball, or sprinting away from (or back to) the device.

4 Claims, 12 Drawing Sheets

(56) References Cited

U.S. PATENT DOCUMENTS

| | | | | | |
|---|---|---|---|---|---|
| 4,998,727 | A * | 3/1991 | Person | A63B 69/00 | 273/446 |
| 5,045,872 | A * | 9/1991 | Yoshimura | G03B 37/02 | 396/20 |
| 5,100,135 | A * | 3/1992 | Bourgeois | A63B 69/0075 | 473/420 |
| 5,294,111 | A * | 3/1994 | Bloch | A63B 71/0686 | 473/415 |
| 6,375,584 | B1 * | 4/2002 | Shapiro | A63B 69/002 | 473/419 |
| 6,424,598 | B1 * | 7/2002 | Shultz | A63B 69/002 | 248/116 |
| D588,476 | S * | 3/2009 | Wehrly | D10/40 | |
| D654,382 | S * | 2/2012 | Barr | D10/40 | |
| 2012/0157246 | A1 * | 6/2012 | Glover | A63B 43/00 | 473/570 |
| 2013/0260924 | A1 * | 10/2013 | Mourouzis | A63B 69/002 | 473/420 |

* cited by examiner

ATHLETIC TIMING DEVICE

CROSS-REFERENCE TO RELATED APPLICATIONS

This application claims the benefit of U.S. Provisional Patent Application No. 62/104,903 filed 19 Jan. 2015, which application is herein expressly incorporated by reference.

FIELD

The present disclosure generally relates to an athletic timing device, more particularly relates to a timing device activated by a trigger for use in athletic activities, such as football, timed running events or the like.

BACKGROUND

This section provides background information related to the present disclosure which is not necessarily prior art.

Sports are an immensely popular pastime the world over. They are played and enjoyed by the very young, the very old and everyone in between. Athletes range from casual backyard athletes to multi-million dollar professionals. A commonality across all sports and levels of play is that timing is important.

Accurate timing in sports is critical to improving in practice, ensuring fair play in casual and professional leagues alike, and generally creating the fun and competitive atmosphere that makes athletics so popular. Timing, however, can be very difficult to manage in sports. Without a dedicated official to keep time players must do it themselves. Management of timing without an official is both difficult and susceptible to cheating. A salient example is in pick-up American football games. These games often replace tackling with grabbing a flag or touching a player to render the ball carrier "down" and to stop the play. Games are typically played shorthanded, with limited or no blockers. As a result, players often institute a "no-rush" rule where the defensive players cannot cross the line of scrimmage and attempt to down the quarterback (known as rushing) without waiting a specified time to cross the line of scrimmage. The current common practice is for the defensive players to count aloud. However, this practice is prone to inaccuracies and dishonesty if a player intentionally counts too quickly. This practice often leads to arguments and bad feelings which can ruin an otherwise enjoyable game.

Even for athletes who have access to dedicated coaches and timekeeping officials, the need for a flexible timing device is significant. Serious athletes practice often. Many skills that athletes train in practice require complex timing. To use another football example, a receiver often practices timing on his or her routes. The receiver must often run for a certain time before changing direction and looking for a pass at a certain time after changing direction. The timing is critical as success of the quarterback depends on throwing the ball to an anticipated location of the receiver. Practicing such skills requires a coach to watch intently with a stopwatch and critique the receiver. This process can be too time-consuming for smaller programs or for receivers who are not likely to see much playing time. In addition to football, runners, basketball players, and soccer players, and the players of other sports frequently practice timed drills, for which it would be cumbersome to carry and watch their own time.

Accordingly, the present teachings seek to solve the problem of unreliable or unwieldy timing during many sporting events, practice situations, and other game activities.

SUMMARY

This section provides a general summary of the disclosure, and is not a comprehensive disclosure of its full scope or all of its features.

The present disclosure generally provides an athletic timing device for use during athletic events, practice sessions, or other game activities by players, coaches, or officials. In one embodiment, the athletic timing device includes a durable, impact-resistant outer shell. The outer shell may include a low-profile region and a component housing region. The low-profile region includes a sensor. The component housing region includes internal components. The internal components include a display, controls, feedback devices, a processing unit, and other components needed to implement the contemplated features. The athletic timing device is configured to minimize the thickness of the low-profile region. The sensor is primarily designed to minimize thickness and obtrusiveness. The combination of sensor design and locating the internal components in the housing region away from the low-profile region allows the low-profile region to achieve a minimal thickness that is less disruptive to athletic activities than higher profile designs.

The athletic timing device can be configured and controlled using controls mounted to the device or using an external means. The device may provide the user with audio, visual, tactile, or a combination of those types of feedback either through feedback mechanisms on the device itself (e.g., a built-in speaker) or through an external device. Further, the device can be triggered either by the sensor located on the device or by an external unit. The external operation, feedback, and sensor devices may communicate with the athletic timing device using wired or wireless methods.

In accordance with one particular application, the present teachings provide an athletic timing device including a housing having a forward region and a rearward region. The forward region houses a plurality of internal components. The rearward region is a reduced profile region. A sensor is carried by the housing. The reduced profile region of the housing facilitates activation of the sensor without interfering with normal athletic activities.

In accordance with another a housing and a timer carried by the housing. A display is also carried by the housing and is electronically coupled to the timer. A sensor for controlling the timer is carried by the housing within a recess of the housing.

BRIEF DESCRIPTION OF THE DRAWINGS

The drawings described herein are for illustrative purposes only of selected embodiments and not all possible implementations, and are not intended to limit the scope of the present disclosure.

FIG. 1.2 is a front view of the athletic timing device in accordance with the present teachings.

Corresponding reference numerals indicate corresponding parts throughout the several views of the drawings.

DETAILED DESCRIPTION OF CERTAIN ASPECTS

Figure 1:
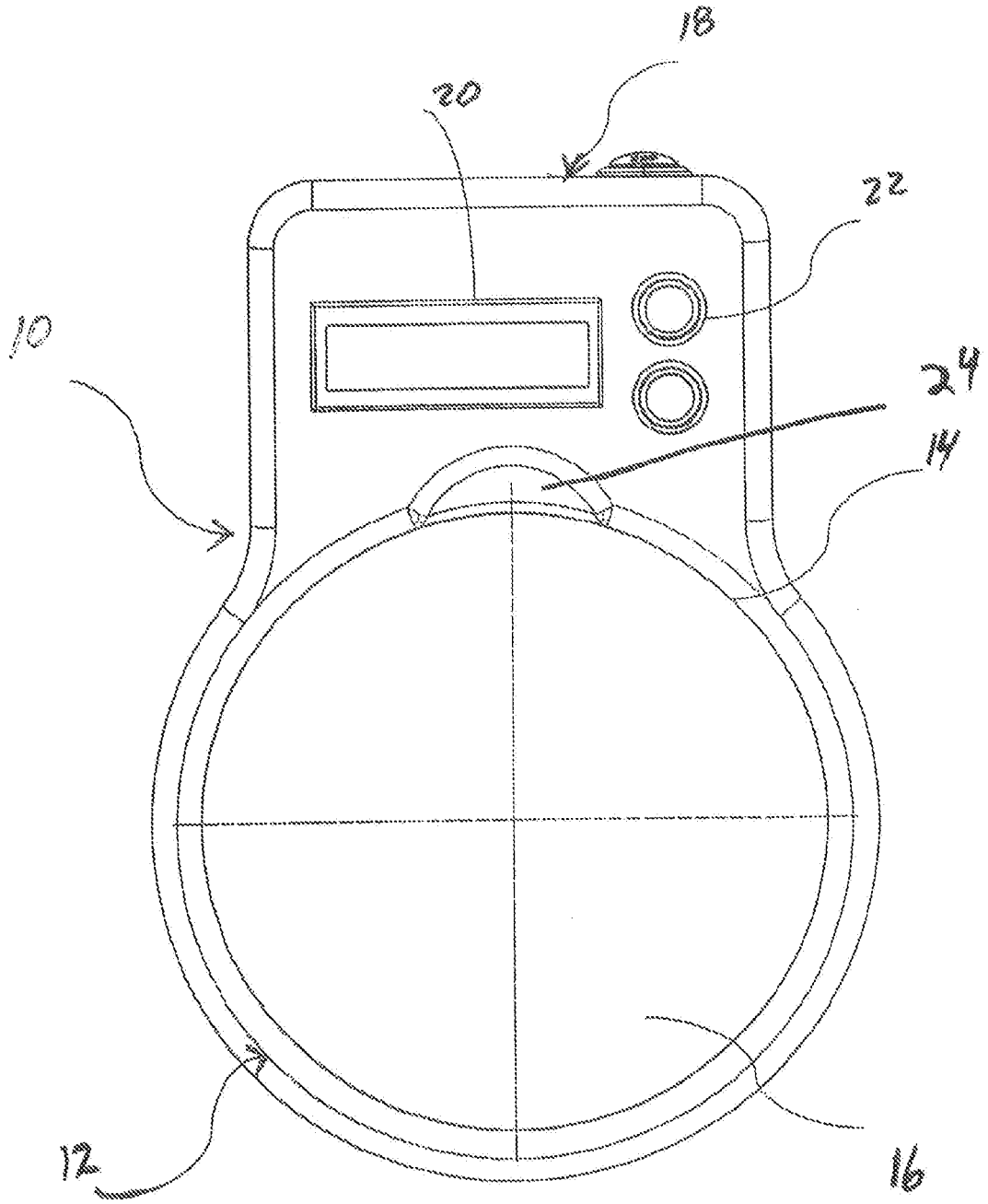
FIG. 1 is a top view of an athletic timing device in accordance with the present teachings.

Example embodiments will now be described more fully with reference to the accompanying drawings.

With general reference to FIGS. 1-3, 5 and 7, an exemplary embodiment of an athletic timing device constructed in accordance with the present teachings is illustrated and generally identified at reference character 10. The athletic timing device 10 is shown to generally include a housing or durable outer shell 12. As illustrated, the durable outer shell 12 may be configured to have a recessed region 14 at an upper surface thereof. Inside the recessed region 14, a sensor 16 may be mounted to the outer shell 12. The sensor 16 may be mounted to the shell 12 in any manner well known in the art. For example, the sensor 16 may be mounted to the outer shell 12 using adhesive, a Velcro® brand fastening arrangement, or another permanent or non-permanent fastening method.

The athletic timing device 10 may also include a component housing region 18. The component housing region 18 may contain some of the internal components of the device 10. For example, the component housing region 18 may contain an integrated display 20, and controls 22 for configuring and operating the device. In the embodiment illustrated, the controls 22 are shown as push buttons. The controls 22 may also include separately or in combination a touch screen, switches, or other components, whether presently known or later discovered that would allow control and configuration of the athletic timing device 10.

In one embodiment, the outer shell 12 may be constructed of a material that is resistant to permanent deformation, shattering, or other damage caused by hazards of the athletic field of play, such as an athlete stepping on the device during play. For example, the outer shell 12 may be constructed of polycarbonate plastic. Other durable, impact-resistant materials, including certain metals, other plastics, and any other material of sufficient strength, impact-resistance, and formability may be alternatively used. The above materials are merely examples of materials resistant to permanent deformation, shattering, or other damages in the field of athletic play, and that may be used to comprise the outer shell 12. Other materials now known or later discovered in the field of material science and exhibiting similar properties may also be used.

In one embodiment, the outer shell 12 may also have varying thickness or additional material, in certain high load or high wear areas for added durability. The additional material may be made of the same material as the outer shell 12 or another durable material, such as a foam material. The outer shell 12 may also be constructed to be water-resistant or even water-proof, for example, by making the outer shell 12 out of a non-porous plastic, or by application of a hydro-phobic coating. Other methods or materials presently known or later discovered commonly used for water-resistance applications may also be used.

In the side view, the shell 14 may taper from front to back. As illustrated, within the scope of the present teachings, whether presently known or later discovered, so long as they provide a region to mount at least one sensor 16.

The sensor 16 may be used to activate the timer or other function of the athletic timing device 10. The sensor 16 may be adjustable to allow an object of various weights or sizes to trigger the sensor. For example, the sensor 16 may be made in such a way (for example with a variable spring constant or a variable resistor) as to allow the user to configure the force required to activate the sensor 16. Other methods for adjustment of the sensor 16 or the triggering threshold of the sensor 16 may be employed, depending on the type of sensor 16 used in a particular embodiment.

The sensor 16 may have a thin and low profile design, to minimize interference with athletic activities. The low profile of the sensor 16 facilitates uses such as a football to be placed on the sensor 16 without affecting normal play, or the foot of a runner to be placed on the sensor 16 at the start line of a race. Further, the sensor 16 may be constructed of materials that are resistant to heavy loading and blunt and sharp impacts, which are likely to be encountered during use. For example the body of the sensor 16 may be made of polypropylene or a high strength composite. The sensor covering may be made of vinyl or para-aramid synthetic fiber (e.g., KEVLAR). These materials are merely examples of durable materials that are resistant to heavy loading or impacts, and other materials now known or later discovered may also be used. The sensor 16 may also include or be coated with material which is water-resistant or water-proof. For example, the cover may be a water-proof material like vinyl or may be coated in a commercially available hydrophobic coating. The sensor 16 may also be designed so that it functions reliably in a wide range of weather conditions, including summer and winter conditions. For example materials that do not suffer degradation in function at sub-freezing temperatures, such as certain foams or spring designs may be used.

As shown in FIG. 1, in one embodiment, a sensor 16 may be composed of two electrical contacts that come into contact, completing a circuit when pressure is applied. Compressible materials such as open-cell foam may be used to prevent the contacts from touching when the sensor is not being loaded, although other similar materials may also be employed. Open-cell foam is merely one example of such a compressible material and other compressible materials now known or later discovered may also be used. The sensor 16 may be covered with a durable outer layer such as vinyl or other synthetic fabrics, although other materials with sufficient durability and longevity may also be employed. Touchless sensors, particularly optic and acoustic sensors may also be employed. For example, an optical sensor that triggers when a beam of light is occluded from a photodetector, or optical or acoustic reflective sensors that trigger based on a shorter return time of the medium when an object is placed in the path of the sensor may be used. Other sensor designs, such as a strain gauge, push button sensors, or any other sensor design that allows for a low-profile, durable implementation may also be used.

Figure 2:
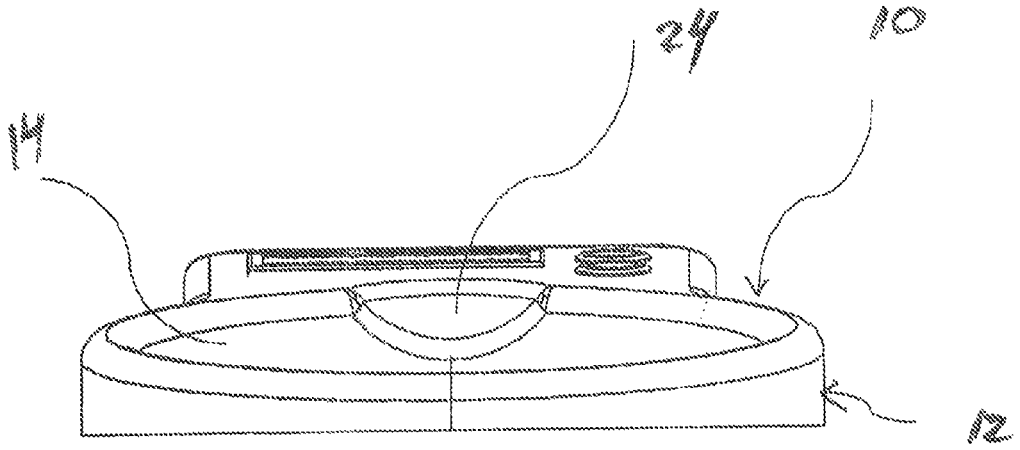
FIG. 2 is a front side view of the athletic timing device of FIG. 1.

As perhaps best shown in FIGS. 1 and 2, the athletic timing device 10 may include a recessed and partially spherical depression 24 proximate an upper region of the recessed region 14. This recessed spherical depression 24 may be useful for athletic activities such as supporting a football prior to a kickoff or prior to snapping the ball. The sensor 16 may be arranged such that removal of the ball from the depression 24 starts the timer.

Figure 3:
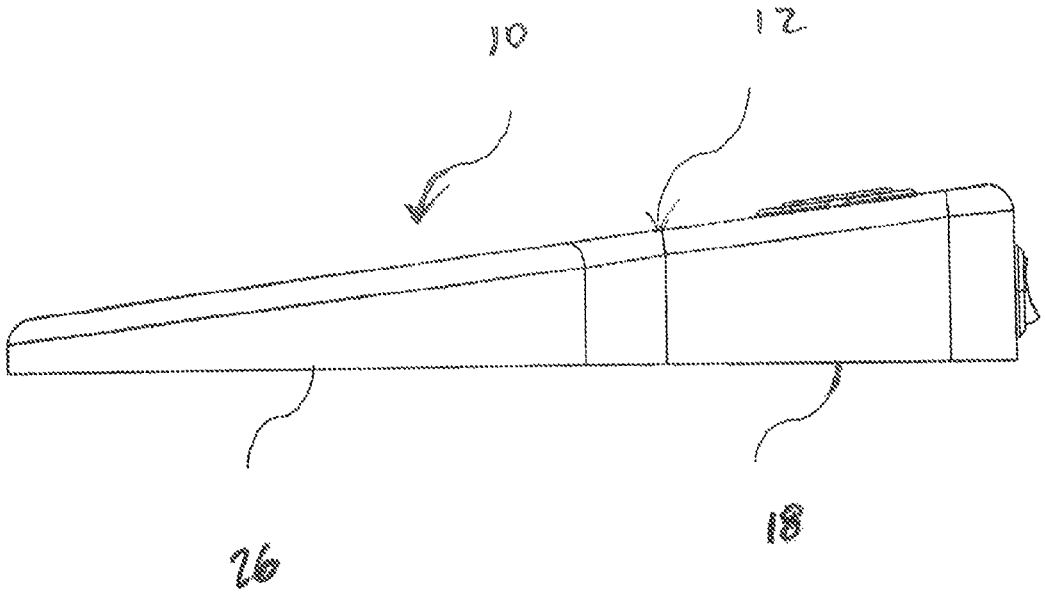
FIG. 3 is a right side view of the athletic timing device oriented 90 degrees from the view shown in FIG. 2.
Figure 4:
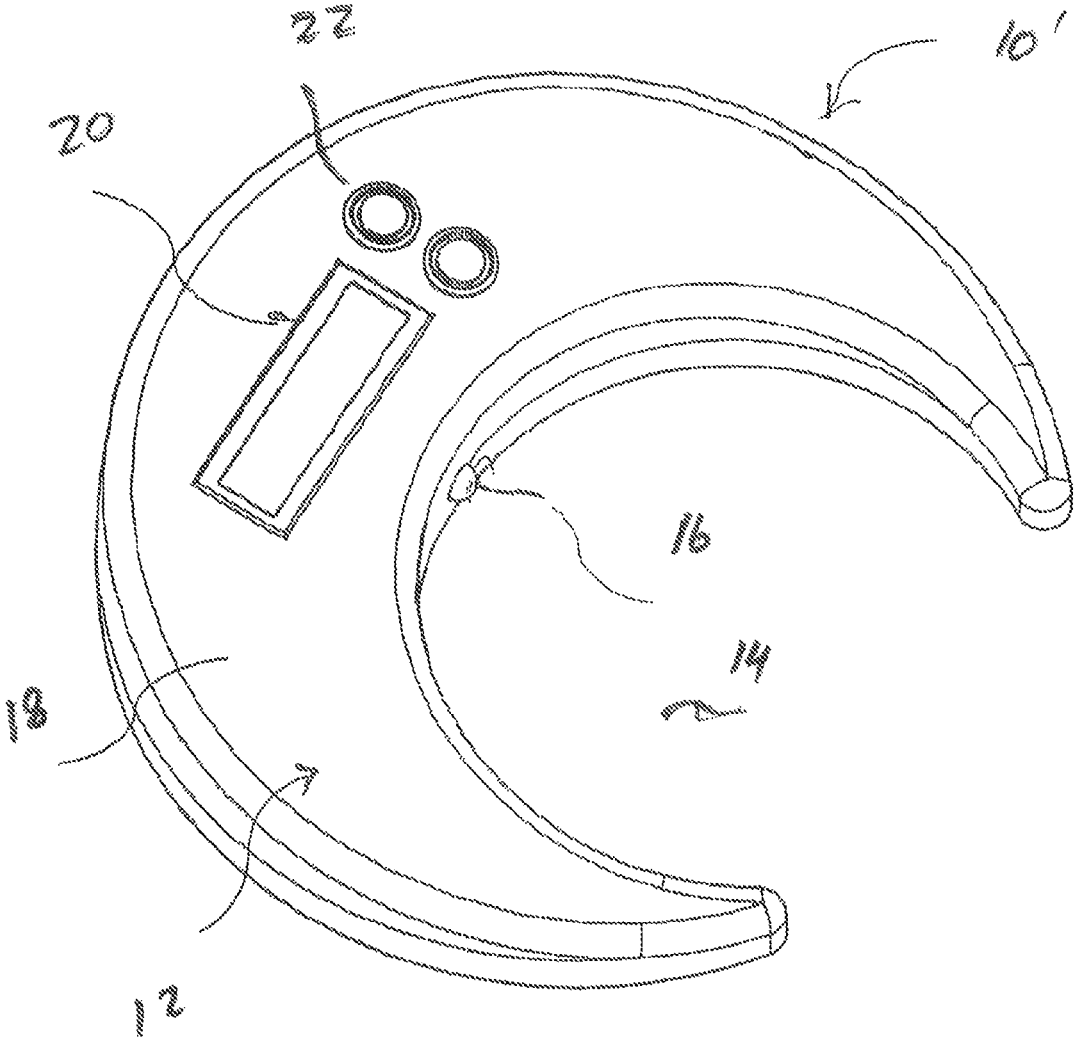
FIG. 4 is an isometric view of an alternative embodiment of an athletic timing device in accordance with the present teachings.

FIG. 3 more particularly shows a tapered or wedge-shaped configuration of the athletic timing device 10. This shape allows the thickness of the device to be kept to a minimum, increasing the profile only towards a forward end of the device 10 where the internal components are housed. This arrangement, coupled with the thin design of sensor 16 creates a low-profile region 26. This low-profile design minimizes interference with normal athletic activity. Particularly, low-profile region 26 minimizes the interference of the athletic timing device 10 with various athletic activities. This region 26 minimizes the thickness of the device 10 to allow athletes to easily activate the sensor 16 without interfering with normal athletic activities. For example, a runner could easily place a foot or portion of a foot on the sensor 16 without upsetting their normal position. In another example, an American football player playing the position of center could place the football on low-profile region 18, and the ball, and therefore the center's hand, would be in a similar position as if the ball was placed directly on the ground. In the embodiment of FIG. 4, the ball could even be placed on the playing surface itself, allowing no disruption to normal play.

As shown in FIGS. 2 and 3, the component housing region 18 may be raised to allow the internal electronic components to be mounted and protected. The component housing region 18 may be shaped to allow the athletic timing device 10 to be easily picked up or carried in one hand. For example, as shown in FIG. 1, the component housing region 18 may be rectangularly shaped, when viewed from the top down. However, alternative shapes that would facilitate containment of the internal components and ease of handling could also be employed within the scope of the present disclosure.

Figure 5:
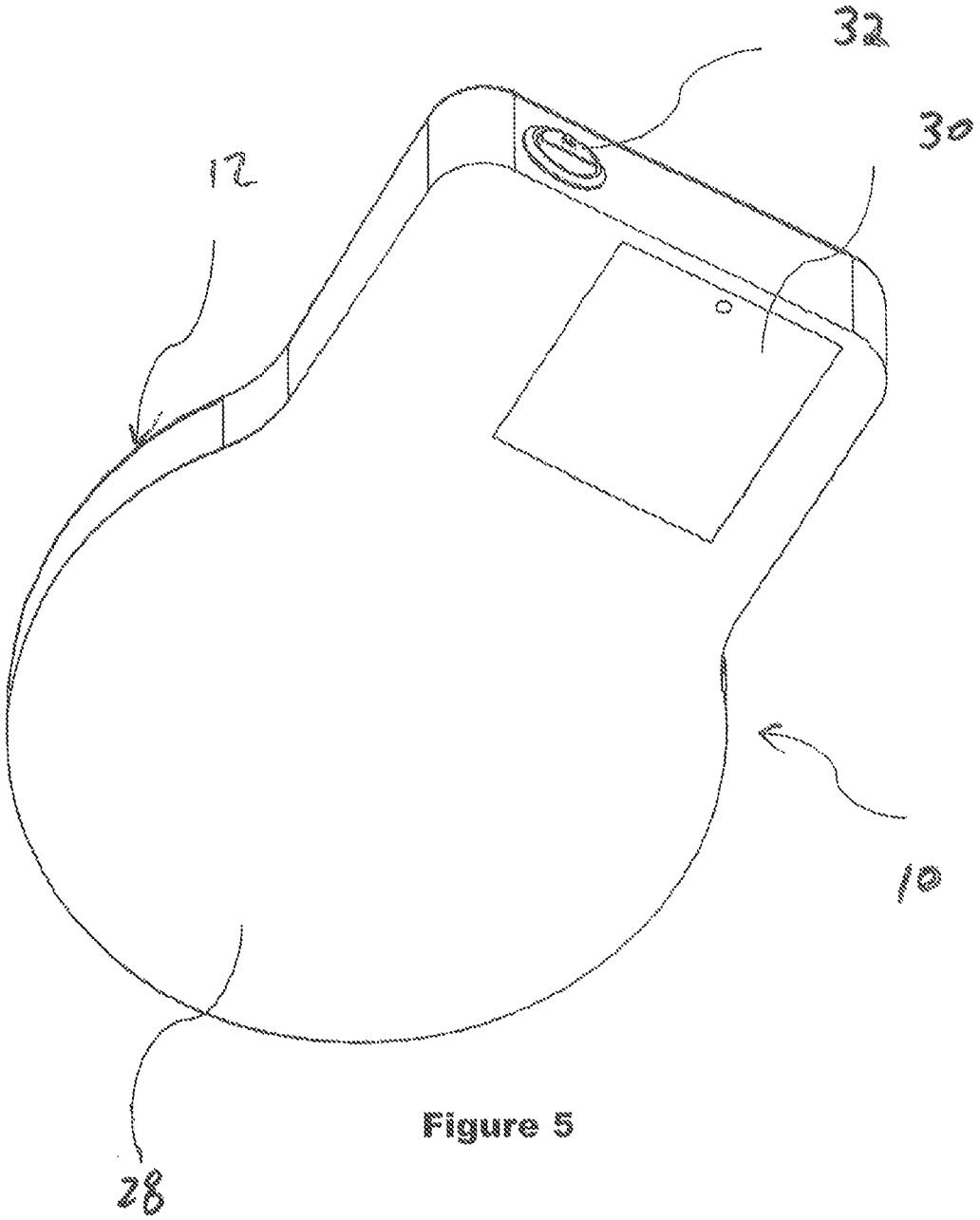
FIG. 5 is an isometric view of the bottom of the athletic timing device of FIG. 1.

With particular reference to the bottom perspective view of FIG. 5, the athletic timing device 10 may contain a bottom plate 28. The bottom plate 28 may have a removable battery cover 30, which allows access to the batteries or other power supply for the athletic timing device 10, and may be secured by any appropriate fastening mechanism, such as screws or tabs. A power button 32 may be used to turn the athletic timing device 10 on or off. The power button 32 may include a simple switch, but any other device or method for activating or deactivating the device, now known or later discovered, may also be used. The bottom plate 28 may be composed of the same material as the outer shell 12 or another similar material that is durable and impact-resistant. In the embodiment illustrated, bottom plate 28 may include a non-slip material to prevent the athletic timing device 10 from undesired movement relative to the surface of play during use. In one embodiment, the bottom plate 28 is fitted with threaded studs that can accept standard football cleat spikes or rubber pads for use in grass or on hard surfaces respectively. Alternative methods could also be employed to ensure that the athletic timing device 10 does not slip during use.

Figure 6:
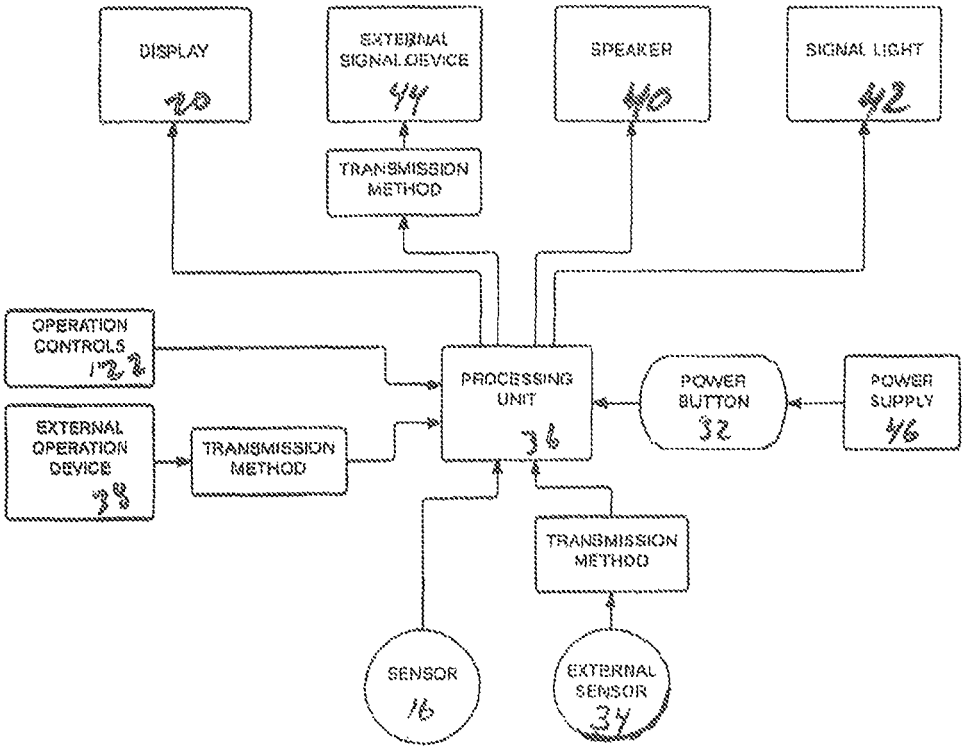
FIG. 6 is a block diagram illustrating the major components of the athletic timing device of FIG. 1.

FIG. 6 shows an example of a block diagram representation of the components of the exemplary embodiment of athletic timing device 10. The sensor 16 and an external sensor 34 send signals to a processing unit 36. This processing unit 28 may consist of a micro controller and additional components as necessary to implement the features of the athletic timing device 10 or other representative means. The processing unit 36 is configured and operated by use of the controls 22 and an external operation device 38. The processing unit 36 outputs signals to control the display 20, a speaker 40, a signal light 42 and an external signal device 44. A power supply 46 provides electrical power to the processing unit 36 and other electrical components within the athletic timing device 10. In one embodiment, the power supply 46 includes standard batteries. Other examples of power supply 46 include a rechargeable battery or a wired power supply using standard home power or another standard such as 5V USB power could also be implemented in place of or in addition to a standard battery system. The battery system could feature plug in or wireless recharging. The above examples of power supply 38 are merely provided as examples. Other technologies now known or later discovered in the field of power supply may also be used within the scope of the present disclosure.

In the embodiment illustrated, the controls 20 may include durable buttons, which can withstand heavy usage and incidental high loading such as being stepped on by a user during the course of play. Other methods of input that maintain the degree of control, usability, and durability, such as touch screens, voice controls or other methods, now known or later discovered, may also be employed in addition to or in place of push buttons within the scope of the present disclosure.

It will be understood that the external operation device 38 may be used in addition to in place of the controls 20. The external device 30 may be any device that can transmit control and configuration commands to the processing unit 36, such as a standard personal computer or smartphone or a proprietary device. The external operation device 30 may connect to the processing unit 28 through a wired transmission such as through a USB cable or other wired transmission capable of transmitting and receiving electronic data, or through a wireless transmission protocol such as BLUETOOTH, wireless Ethernet, or any other wireless protocol capable of transmitting and receiving electronic data. The external operation device 38 may allow more complex configuration and control of the athletic timing device 10 such as customizing alarm tones or sounds, customizing display messages, or adding new modes or features to the device. For example, a user may upload a media file from their smartphone to use as the audio feedback with the athletic timing device 10. In one embodiment, the external operation device 38 may also allow information to be retrieved or transmitted from the athletic timing device 10 for analysis and storage. For example, the recorded times could be presented in a table or graph to allow comparison across numerous repetitions to measure improvement or variation in a user's performance. Other present or future configurations and controls possible using the external operation device 38 and the athletic timing device 10 may also be implemented.

The external sensor 34 may include a device that is able to communicate remotely, in either a wired or wireless communication protocol such as those discussed for use with the external operation device 38, with the low-profile athletic timing device 10. This external sensor 34 may take various embodiments such as a bracelet-type sensor that is worn by the user during athletic activity or a sensor embedded within a football or other game ball.

In the embodiment illustrated, shown for example in FIG. 5, the display 20, may be located below the surface of the outer shell 12 and a section of the outer shell 12 is left transparent to allow the display 20 to be viewed by the user, while protecting it from impacts and damage. The display 20 may be installed in other ways that would allow it to be visible to the user and protected from damage during use. For example, the display 20 may be mounted flush with the outer shell 12 and protected with an integrated or external lens. The display 20 may also be enhanced by using filters to reduce glare from sunlight or artificial lighting to enhance readability by users. An example of a glare-reducing filter that could be employed is a polarizer, although any glare-reducing technology commonly employed in such applications may be used. In one embodiment, the display 20 is a liquid crystal display (LCD) capable of displaying two lines of text and numbers. However, the display may alternatively consist of an LCD or LED display and be capable of displaying solely numbers on a single line in one color, or a more complicated display capable of displaying complex graphics and colors on many lines. The display 20 may incorporate additional features such as control functions through means of a touch screen, or other implementation, or backlighting for low-light visibility.

Figure 7:
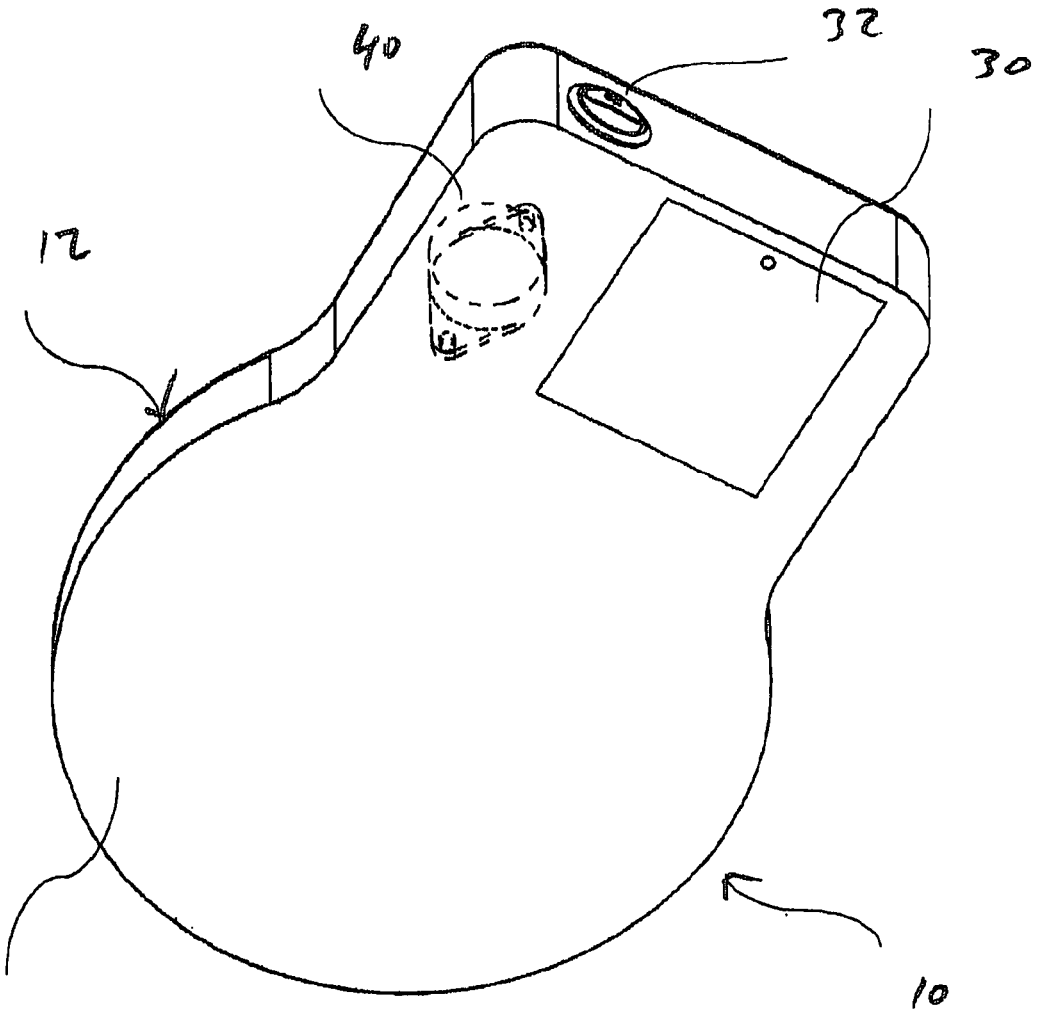
FIG. 7 is a perspective view similar to FIG. 5 illustrating a speaker of the athletic timing device of the present teachings.

Referring to FIG. 7, in the embodiment illustrated, the speaker 40 may be mounted within the outer shell 12. The speaker 40 may be partially exposed, for example by designing an opening in the outer shell 12 to allow better sound conduction, or mounted in any other way that allows clear transmission of sound to users. The speaker design may be able to produce a wide range of frequencies or may be of a design that emits only a single frequency, for example, a piezo buzzer. Multiple speakers may be used, whether the same or different types so long as the system can generate a low enough volume for comfortable use in quiet enclosed spaces and a volume loud enough to be heard in noisy outdoor settings. In one embodiment, the athletic timing device 10 may have a small commercial loud speaker capable of reproducing a wide range of frequencies, and a piezo buzzer capable of producing a single frequency at high volume for use in noisy outdoor settings.

The signal light 42 may provide additional feedback to the user. The signal light 42 may be mounted anywhere on the athletic timing device 10 that would make it visible to the user. Multiple lights may be used. The signal light may be a single tone or multi-tone LED or other suitable light source. The signal light 42 is capable of displaying solid illumination, and flashing or intermittent illumination.

The external signal device 14 may be a device that connects to the athletic timing device 10 remotely, either through wired, or wireless means such as those discussed for the external operation device 38. The external signal device 44 may provide feedback to the user from a separate source remote from the athletic timing device 10. The feedback could be in the form of audio, visual, tactile, or some combination of those types of feedback. The external device 44 could be either a generic device such as a personal computer or smartphone or a proprietary device such as an external speaker, display, or wristband. The external device could take other forms, now known or later developed, that sync with the athletic timing device 10 to provide feedback to the user.

Figure 8:
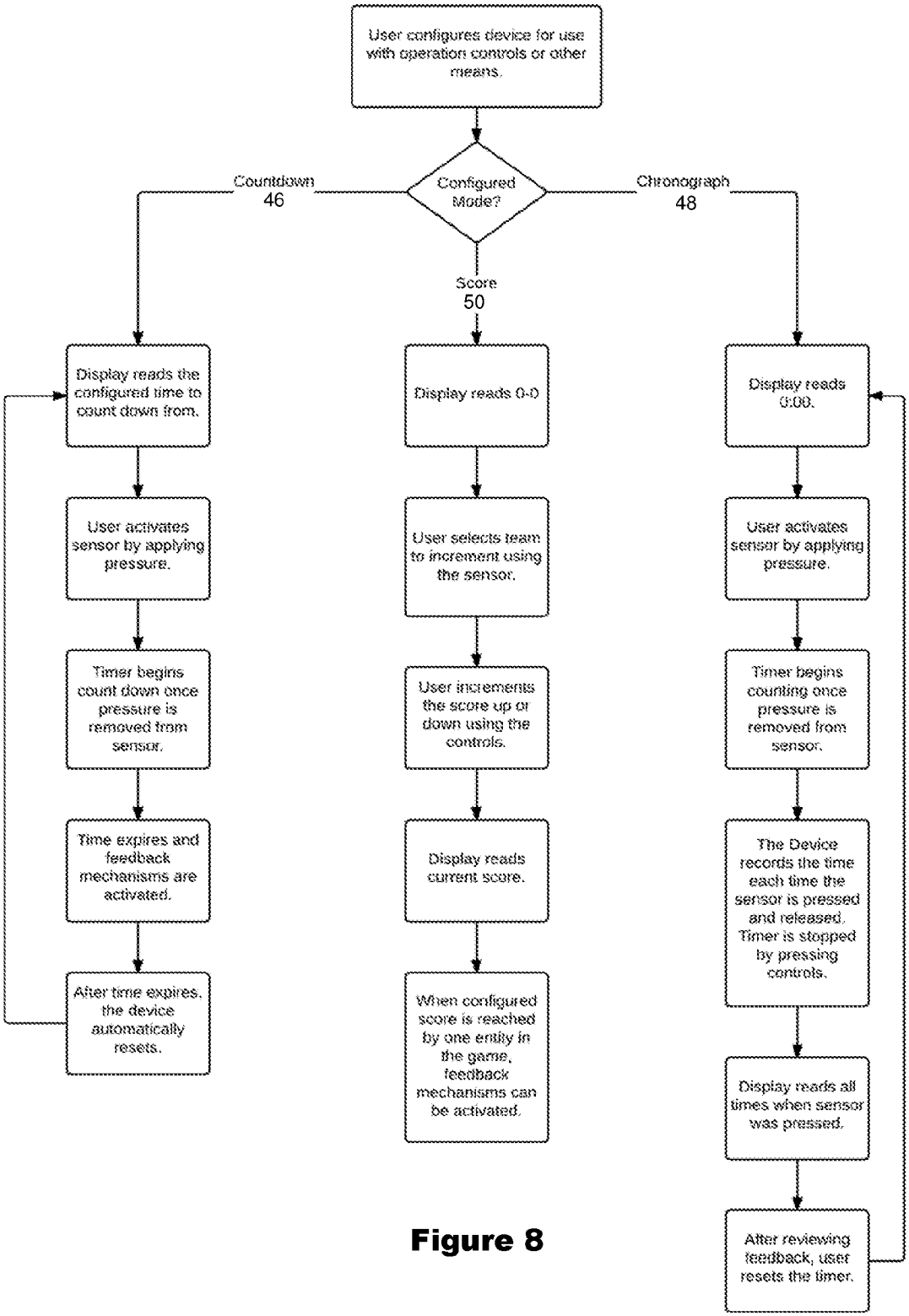
FIG. 8 is a logic flow diagram general illustrating the operation of the primary modes of the athletic timing device of FIG. 1.
Figure 9:
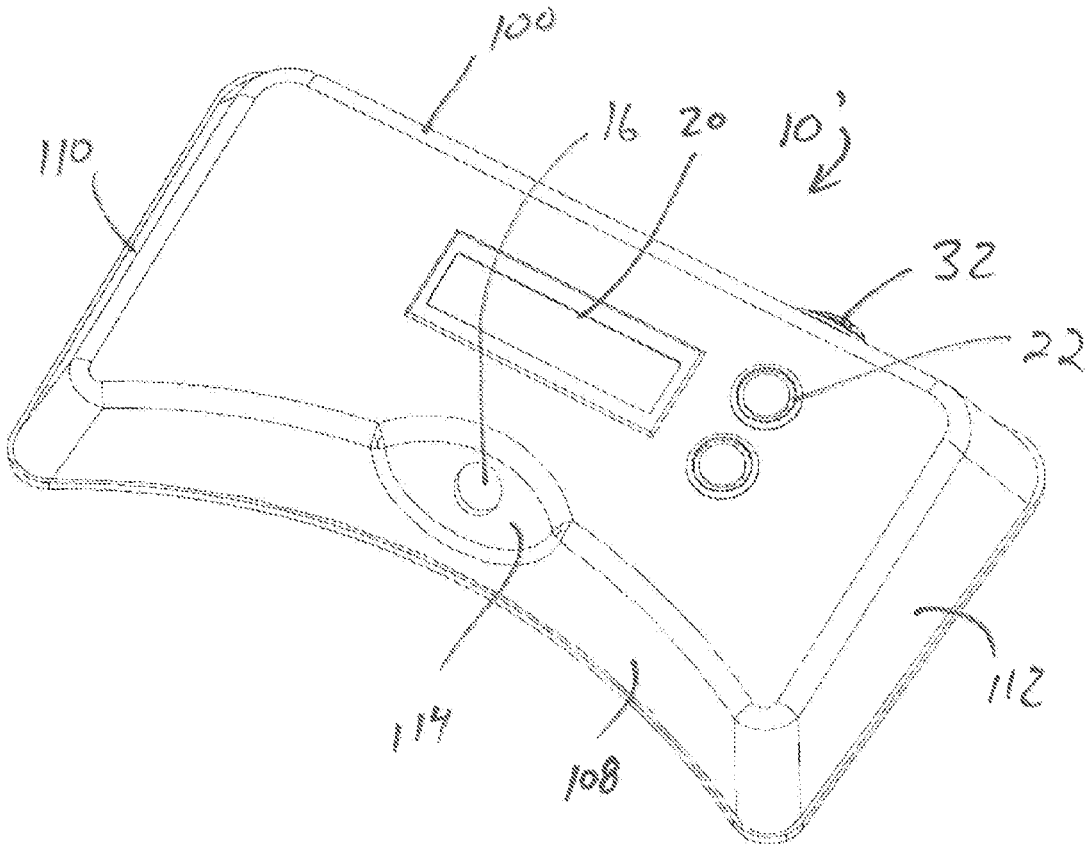
FIG. 9 is a perspective view of another athletic timing device in accordance with the present teachings.
Figure 10:
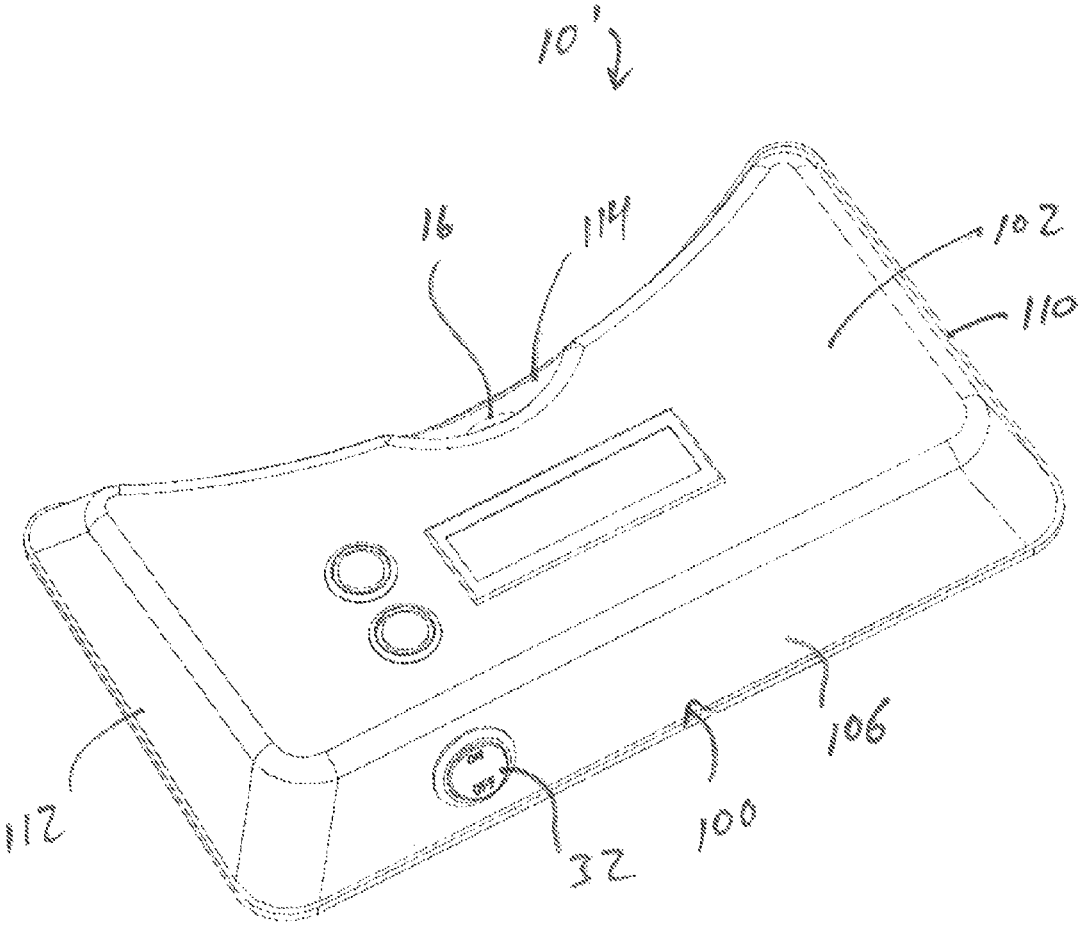
FIG. 10 is another perspective view of the athletic timing device of FIG. 9.
Figure 11:
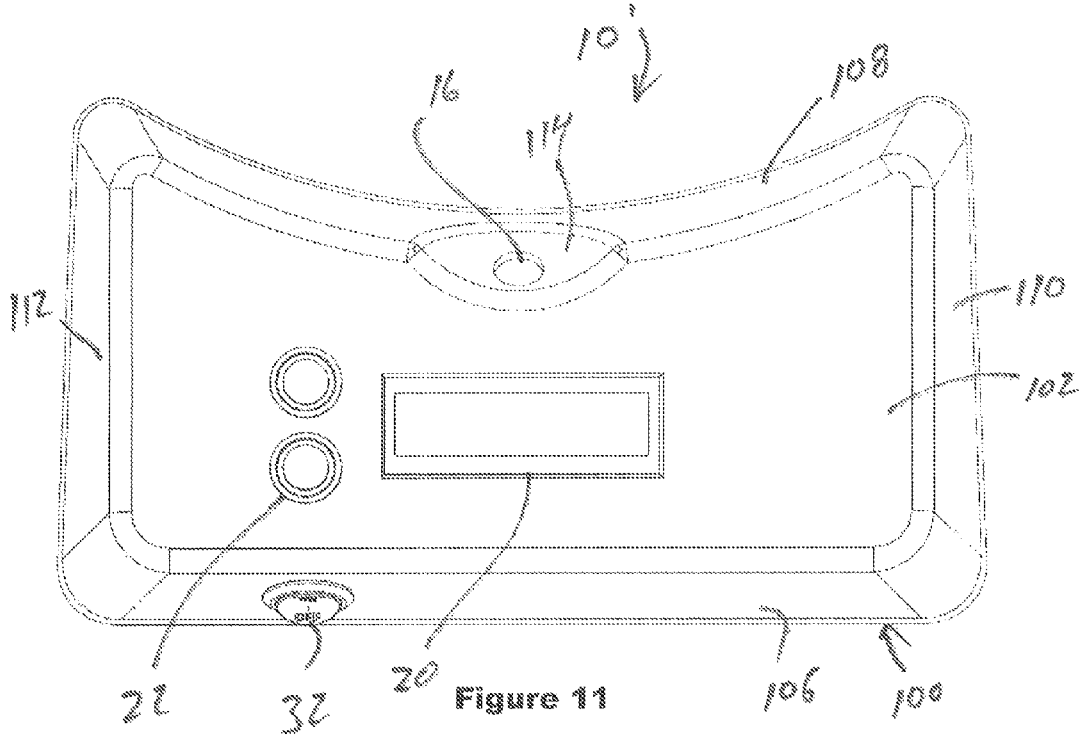
FIG. 11 is another perspective view of the athletic timing device of FIG. 9.
Figure 12:
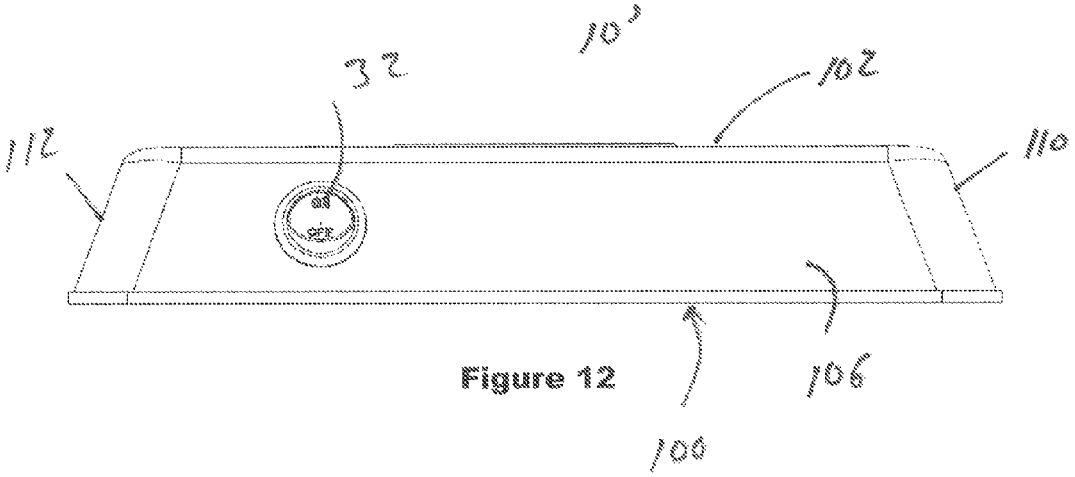
Figure 13:
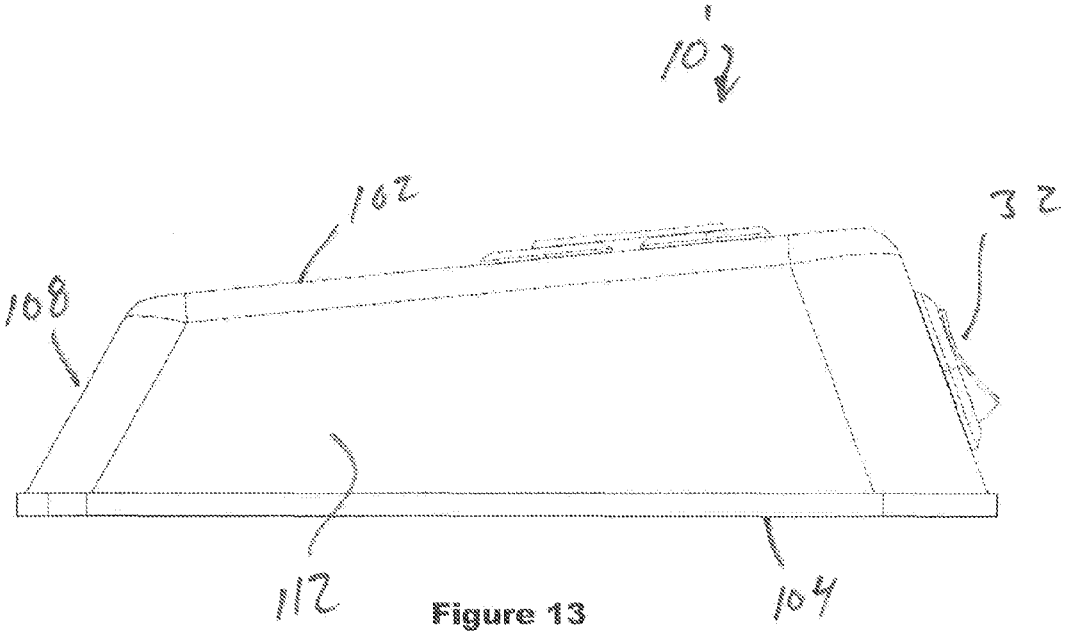
FIG. 13 is a left side view of the athletic timing device in accordance with the present teachings.
Figure 14:
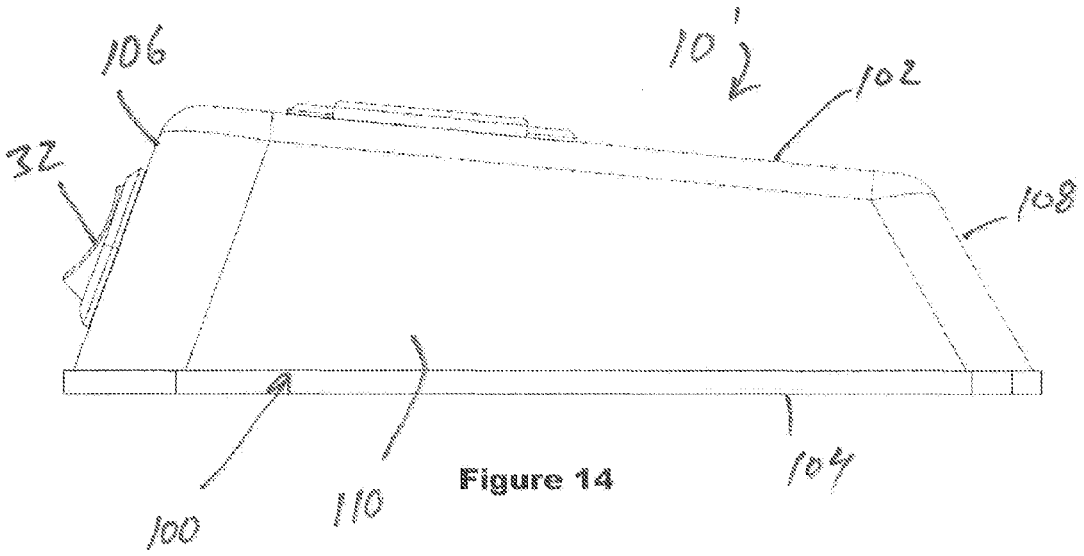
FIG. 14 is a right side view of the athletic timing device in accordance with the present teachings.
Figure 15:
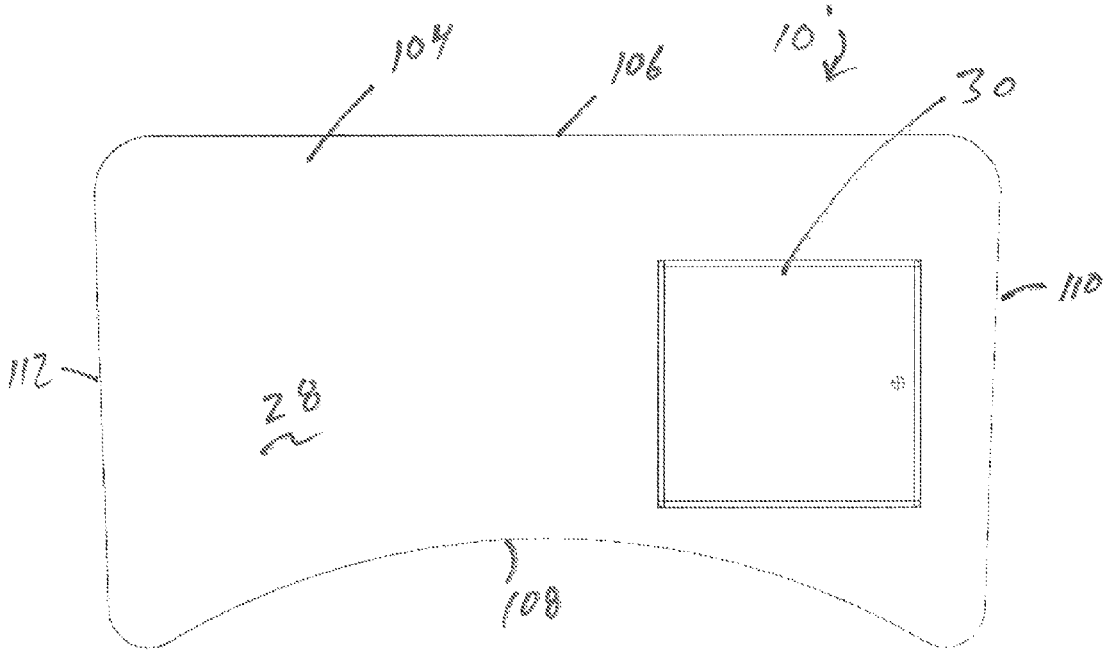
FIG. 15 is a bottom view of the athletic timing device in accordance with the present teachings.

FIG. 8 generally illustrates the general operation of the athletic timing device 10 of the present teachings. The user, using the controls 22, or the external operation device 38 may configure the athletic timing device 10 in various modes. The following provides examples of certain modes, but additional modes may be included or users may program their own modes within the scope of the present teachings. For example, in one embodiment, the athletic timing device 10 is configured with a countdown mode 46. In the countdown mode 46, the user can select the number of timers desired and configure the duration of each timer using predetermined increments. Once configured, the user activates the sensor 16 as discussed above, for example, by placing a football on the sensor. The display 20 will read at least the configured time. Once the object triggering the sensor 16 is removed, a signal is sent to the processing unit 36 and the countdown begins. The athletic timing device 10 can be configured to provide a variety of tones and sounds through the speaker 40, and visual cues through the display 20 and signal light 42 and during the countdown. Cues can also be sent to the external feedback device 44 during the countdown, all of which provide valuable cues to athletes in training or during play. Once the programmed time elapses, the athletic timing device 10 will send another round of programmed feedback to the specified feedback devices. At this point the user may review their performance and reset the device for another countdown or change to another mode.

In one embodiment, the athletic timing device 10 is alternatively or additionally configured with a stopwatch or chronograph mode 48. In the stopwatch mode 48, the user arms the sensor 16 in the same manner as described throughout and the timer activates ones the sensor 16 is released. The timer begins counting upward. Each time the sensor 16 is activated and released the processing unit 36 stores the time at which it was pressed. Pressing any of the controls 22 will stop the timer. Users can then cycle through the recorded times on the display 20 using the controls 22. The user may reset the timer and clear the stored times as well. Times may be downloaded to an external device using the external operation device 38.

Another example of a mode with which athletic timing device 2 can be configured is a score mode 44. Again, this mode 44 may be alternative to or in addition to the modes described above. In the score mode 50, the display 20 will read the current score of an athletic event. In the standard score mode 44, two teams will be scored and begin at 0-0. Other configurations, such as including more than two teams and allowing scoring to begin at a nonzero number can also be included. Users select the team to increment using the sensor 16 and increment the score up or down using the controls 22. Users can configure an ending score, that once reached triggers the desired feedback mechanisms.

In addition, the athletic timing device 10 may have a settings mode. In this mode, the parameters of the device 10 can be configured using the sensor 16 and the controls 22. Parameters to be configured include, type of feedback, timing of feedback, audio volume, etc. These parameters are provided merely for illustration purposes. Other parameters, now known or later developed, and related to providing feedback to a user of a device or a player in a game may also be used.

In one embodiment, the sensor 16 also includes a debounce feature. This is a configurable delay, where the sensor 16 will only send the activation signal and begin the timer if it has been triggered and not released for at least the duration of the de-bounce interval. This feature prevents accidental activation of the timer before the user is ready. For example, if a runner accidentally arms the sensor 16 by stepping on it while taking her position and quickly steps off of it. The runner must step on the sensor 16, continuously for a period long enough to exceed the de-bounce interval.

Turning to FIGS. 9-15, another athletic timing device constructed in accordance with the present teachings is shown and identified at reference character 10'. Given the similarities between the athletic device 10 and the athletic device 10', like reference characters will be used to identify similar elements. To the extent not otherwise illustrated or described, it will be understood that the construction and operation of the athletic timing device 10' is substantially similar to the athletic timing device 10.

The athletic timing device 10' may have a housing 100 including a top side 102, a bottom side 104, a front side 106, a rear side 108 and first and second lateral sides 110 and 112. As illustrated, the top and bottom sides 102 and 104 may be generally planar. The front side 106 may be generally planar and may angle rearwardly as it extends upwardly. Similarly, the first and second lateral sides 110 and 112 may be generally planar upwardly. In the embodiment illustrated, the first and second lateral sides 110 and 112 may have a greater height proximate the front side 106 as compared to a height proximate the rear side 108. As such, the athletic timing device 10' may taper from the front side 106 to the rear side 108. The rear side 108 may be concavely curved and may angle forwardly as it extends upwardly.

The housing 100 may define a recessed portion 114 intersecting the rear side 108 and the top side 102. The recessed portion 114 may be convexly curved. The sensor 16 may be mounted in the recessed portion 114. The sensor 16 may be a proximity sensor such as an infrared proximity sensor. Suitable proximity sensors are commercially available from Zitrades and Geeetech, for example.

The sensor 16 may function in an analog or digital sense to provide a signal indicative of an object within a sensing range. For example, this information may be used by a programmable board to determine if the timer should be triggered. (i.e., an object is within view) and then when the timer should start (i.e., the object has moved outside the view of the sensor).

The foregoing description of the embodiment(s) has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure. One or more example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The invention claimed is:

1. An athletic timing device comprising:

a housing having a generally planar bottom side, a generally planar top side, a front side, a rear side and first and second lateral sides, the front side being concavely curved, the housing defining a recessed portion intersecting the top side and the front side;

a timer carried by the housing;

a display carried by the housing and electronically coupled to the timer;

a speaker carried by the housing and electronically coupled to the timer;

a power supply carried by the housing and electronically coupled to the timer, whereby the power supply is capable of being connected to an external power source during operation and for recharging;

and a touch-less sensor carried by the recessed portion of the housing, wherein the touch-less sensor measures in a horizontal direction away from the front side of the housing and is triggered during an athletic activity when an object is placed in the path of the touch-less sensor, wherein once the object triggering the touch-less sensor is removed, a signal is sent to a processing unit electronically coupled to the timer and the timer is activated.

2. The athletic timing device of claim 1, wherein the device is capable of communicating with external electronic devices.

3. The athletic timing device of claim 1, wherein the sensor is an infrared proximity sensor.

4. The athletic timing device of claim 1, wherein the speaker provides an audio signal.

* * * * *